US007788881B2

(12) United States Patent
Johnson et al.

(10) Patent No.: US 7,788,881 B2
(45) Date of Patent: Sep. 7, 2010

(54) CASE ERECTOR

(76) Inventors: Michael J. Johnson, 5014 W. Barnes Rd., Spokane, WA (US) 99208; Richard A. McQuary, 3207 W. Cleveland, Spokane, WA (US) 99205

( * ) Notice: Subject to any disclaimer, the term of this patent is extended or adjusted under 35 U.S.C. 154(b) by 35 days.

(21) Appl. No.: 12/242,660

(22) Filed: Sep. 30, 2008

(65) Prior Publication Data

US 2009/0093354 A1 Apr. 9, 2009

Related U.S. Application Data

(60) Provisional application No. 60/977,317, filed on Oct. 3, 2007.

(51) Int. Cl.
*B65B 43/24* (2006.01)

(52) U.S. Cl. ..... 53/382.1; 53/382.2; 53/382.3; 493/309; 493/315

(58) Field of Classification Search ..... 53/381.1, 53/382.1, 382.2, 382.3; 493/309, 313–317
See application file for complete search history.

(56) References Cited

U.S. PATENT DOCUMENTS 6,080,095 A * 6/2000 Chen ..... 493/309
6,669,616 B1 * 12/2003 Bierenacki et al. ..... 493/316
7,390,291 B2 * 6/2008 Chiu Chen ..... 493/313
2004/0110619 A1 * 6/2004 Frank et al. ..... 493/309
2008/0113856 A1 * 5/2008 Chen ..... 493/313

* cited by examiner

*Primary Examiner*—Christopher Harmon
(74) *Attorney, Agent, or Firm*—Lee & Hayes, PLLC

(57) ABSTRACT

A case erector is configured to open folded cases. In one example, the case erector includes a planar bearing surface. A semi-circular channel is defined in the planar bearing surface about a center point. Additionally, a notch is located so that the planar bearing surface does not extend to the center point of the semi-circular channel. A plate is in contact with the planar bearing surface. The plate has at least one flange sized for travel within the semi-circular channel so that the plate rotates against the planar bearing surface in a circular manner about the center point. A notch is defined in the plate so that the plate does not extend to the center point of the semi-circular channel. An arm is connected to the plate so that the plate and the arm rotate together with respect to the planar bearing surface. In operation, a folded edge of a folded case is positioned at the center point. One or two arms, moved by plates rotating on bearing surfaces, attach to and open the folded case.

17 Claims, 9 Drawing Sheets

CASE ERECTOR

RELATED APPLICATIONS

This patent application claims priority to U.S. Provisional Patent Application Ser. No. 60/977,317, having title "Case Erector", filed on 3 Oct. 2007 in the United States, commonly assigned herewith, and hereby incorporated by reference.

BACKGROUND

Cases (e.g. cardboard boxes) are commonly sold in a folded flat (i.e. a knocked down) configuration. A case erector is a machine that assembles cases from the folded flat configuration into a three-dimensional form, typically having bottom box flaps taped or glued shut.

Known case erectors have two arms, typically configured with suction or vacuum cups, which grasp two adjacent sides of the box, respectively. Each arm then moves through 45 degrees thereby opening the box. In an application with a single arm, the single arm may move through 90 degrees. In either application, such arms are supported by bearing surfaces, which allow the pivotal rotation.

It is desirable to locate the fold between the two adjacent sides of the box that are grabbed by the two arms co-linearly with an axis about which the two arms pivot. This results in a design challenge, in that it is desirable to locate a (usually) vertical shaft (about which the arms pivot) in the same location that it is desirable to locate the fold in the box.

Two solutions are common. In a first solution, the fold in the box (between the two adjacent sides that are grasped by the arms) can be located "near" (but not exactly collinear with) the shaft about which the two arms pivot. This will cause the box to skew as it is opened. The skew occurs because the fold between the two adjacent sides of the box and the two arms do not pivot about the same virtual center point. This skew is generally unacceptable, and therefore a second solution is common.

In the second solution, the shaft about which the two arms pivot is located above (or below) the box, so that if the shaft were extended in one's imagination, the shaft would be co-linear with the fold between adjacent sides of the box. Since the shaft is located above the box as the box is moved into position to be opened, the arms must extend laterally outward from the shaft and also extend down to the box, so that vacuum cups carried by the arms may contact the adjacent sides of the box. This makes the overall device heavier and more complex, and requires arms having increased strength due to their length and other factors. While this solution allows the arms to be kept parallel to the box sides, (the arms reach down from above or up from below) the structure required to support the erecting arms must be more robust which will increase cost, complexity and overall size of the mechanism.

SUMMARY

A case erector is configured to open folded cases. In one example, the case erector provides first and second arms, each having at least one suction or vacuum device. A planar bearing surface allows at least one of the arms to move between an open position and a closed position. The planar surface defines a semi-circular channel about a virtual center point. In operation, a fold between two adjacent sides of the case is moved into a virtual line passing through the virtual center point while the arms are in the open position, thereby allowing space for the case to enter. The arms are then moved to the closed position, wherein the first and second arms grasp the two adjacent sides, respectively, of the folded flat case. The case is then opened by moving the arms into the open position while the arms maintain their grasp of the case. Movement to the open position is performed by moving each arm through 45 degrees or one arm through 90 degrees. Movement of the arms in a rotary manner about the virtual line results from rotation of a plate supporting each arm, wherein each plate moves against the planar bearing surface and wherein the plate has one or more attached flanges moving through the semi-circular channel defined in the planar bearing surface.

This Summary is provided to introduce a selection of concepts in a simplified form that are further described below in the Detailed Description. This Summary is not intended to identify key features or essential features of the claimed subject matter, nor is it intended for use as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

Overview

The following discussion is directed to systems and methods that erect cases (e.g. systems that open cardboard boxes from a disassembled state to an assembled state). In one example, a case erector configured to open folded cases provides first and second arms, each having at least one attachment device, such as a suction or vacuum device or clamp assembly. A planar bearing surface allows at least one of the arms to move between an open position (wherein a folded flat case is received) and a closed position (wherein the folded case is grabbed) and then moved to the open position (wherein the case is opened into a 3-D box-like shape with open or no flaps on the top and flaps on bottom). In a preferred configuration, each of the two arms moves through approximately 45 degrees. The planar bearing surface defines a semi-circular channel about a virtual center point. In operation, a fold between two adjacent sides of the case is moved into coincidence with a virtual line passing through the virtual center point. Once the fold of the case is in position in the virtual line passing through the virtual center point, the first and second arms move from the open position to the closed position to grasp the two adjacent sides, respectively. Each arm is supported by a plate that moves against a planar bearing surface, wherein the plate is held in place by at least one flange that moves within a semi-circular channel defined within the planar bearing surface. Thus, the plate supporting each arm moves (rotates) in a circular manner, about the virtual center point. The case is then opened as both arms move through 45 degrees from the closed position to the open position, thereby opening the case. Because the fold (i.e. the corner) of the case was located in a virtual line passing through the virtual center point of the semi-circular channel, the arms will remain parallel to the two adjacent box sides, as the box opens in a square or non-skewed manner.

Examples of Case Erectors

Figure 1:
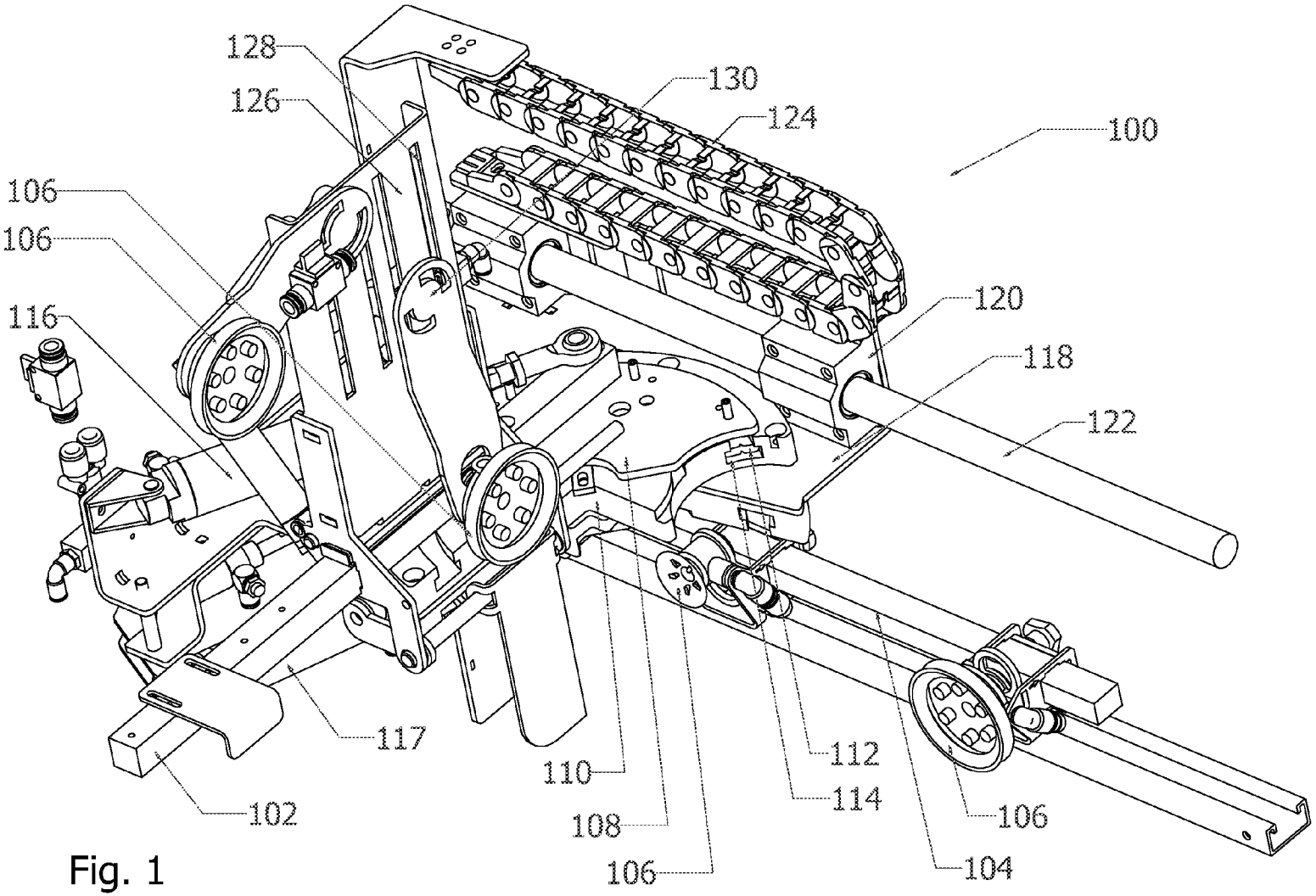
FIG. 1 shows an isometric view of an example case erector, with the arms in the open position.

FIG. 1 shows an isometric view of an example case erector 100, with the arms in the open position. In particular, first and second arms 102, 104 are separated by 90 degrees in the open position, which allows a case to be moved into position between the arms. The 90 degrees between the arms 102, 104 also holds adjacent sides of a box in the appropriate configuration when the box is opened. Each arm 102, 104 may include one or more attachment devices, such as suction cups 106, which are typically powered by a vacuum source. Alternatively, a clamping assembly could be used.

The arm 102 is supported by a plate 108 that rotates against a planar bearing surface 110. (The arm 104 is supported by a similar plate, which is on the other side of base 118 and therefore unseen in FIG. 1.) While a plastic or UHMW material is used for the bearing surface 110 in the example of FIG. 1, metal or alternative material may also be used. A flange 112 attached to the plate 108 moves within a channel 114 defined in the bearing surface 110. Thus, rotation of the plate 108 is in a circular direction, due to the movement of the flange within the semi-circular channel 114. Accordingly, the circular rotation of the plate 108 moves the attached arm 102 in a circular direction. The channel 114 is semi-circular, to allow rotation of the plate 108 between an open position wherein the arm 102 allows a folded case to enter, a closed position wherein the folded case is grasped by the arm 102, and back to the open position wherein the case is opened. Thus, the plate 108 and attached arm 102 moves over approximately 45 degrees, and the bearing surface 110 remains fixed. Similarly, the second arm 104 moves according to rotation of a second plate over 45 degrees, wherein the rotation is through a second semi-circular channel defined a second bearing surface better seen in FIG. 6.

The channel 114 defined in the bearing surface 110 is typically semi-circular in shape, and may extend over approximately 270 degrees of a circle, depending on the application. The center of the circle (about which the semi-circular channel 114 is defined) can be thought of as a "virtual center" since no component is positioned at that location. In fact, the bearing surface 114 defines a notch (best seen as 308 in FIG. 3), which allows a fold between two sides of a case (i.e. a "corner" of the case) to be located at the center or "virtual center" of the semi-circular channel 114.

The arms 102, 104 are moved by actuators 116 and 117, which may operate using a compressed air power source. Alternative technology, such as motor and/or gears may be substituted. In one example, the actuators 116, 117 are attached to plates 108 and 604 (see FIG. 6); alternatively, the actuators are attached to the arms 102, 104. In either case, the actuators provide the force to move plates 108 and 604 against the fixed-location bearing surfaces 110 and 602 (see FIG. 6), whereby the plate and attached arm rotate about the center point.

Both arms 102, 104, supporting plates and bearing surfaces, actuators 116, 117 and other components are supported by a base 118 and two bearings 120. The bearings 120 allows the arm assembly to move along a shaft 122. Typically, the case, once opened, is moved along the shaft 122 into a plow, which aids in closing and sealing the bottom flaps of the case. A hose assembly 124 has a linkage design, which supports the hoses as the arm and bearing surface assembly moves along the shaft 122.

In the example of FIG. 1, the attachment devices 106 (e.g. vacuum cups) are attached to an adjustment plate 126 defining a plurality of adjustment slots 128. A bracket 130 holding the attachment device 106 can therefore be positioned in any desired location.

Figure 2:
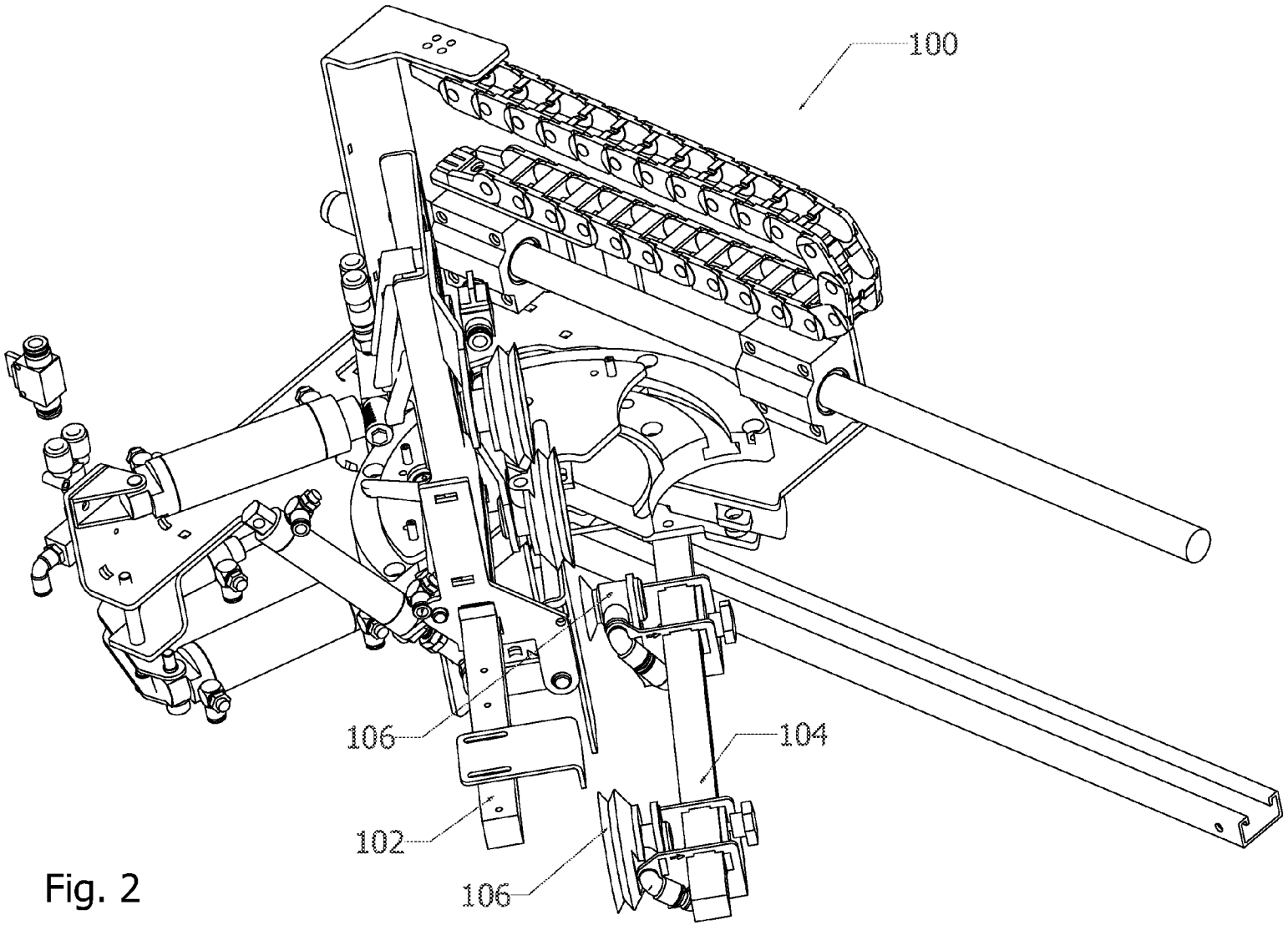
FIG. 2 shows an isometric view of the case erector of FIG. 1, with the arms in the closed position.

FIG. 2 shows an isometric view of the case erector 100, with the arms 102, 104 in the closed position. Note that in the closed position, the suction cups 106 of the second arm 104 are separated from the suction cups of the first arm 102 by only the thickness of the disassembled case. Thus, FIG. 2 shows the arms 102, 104 in the "closed" position wherein they are grasping the still closed case. The case is not shown in this view, for clarity of illustration. Once the two adjacent sides of the case are grasped by the arms 102, 104, the arms are again rotated into the "open" configuration seen in FIG. 1.

A comparison of FIGS. 1 and 2 shows that the plate 108 has rotated counter-clockwise by 45 degrees. This has caused the attached arm 102 to rotate 45 degrees. The plate 108 was constrained in its rotation by the flange 112, attached to the plate 108, which travels within the channel 114 of the bearing surface 110. The arm 104 has similarly rotated 45 degrees. However, the plate to which it is attached is located under supporting plate 118, and is therefore not shown. Note that the plate 108 somewhat resembles a piece of pizza with a portion near the center point removed. Removal of this portion near the center point results in an open area that allows the fold of the case to move into a collinear position with a virtual center line passing through the virtual center point, wherein the virtual center point is the center of the semi-circle formed by the channel 114.

Figure 3:
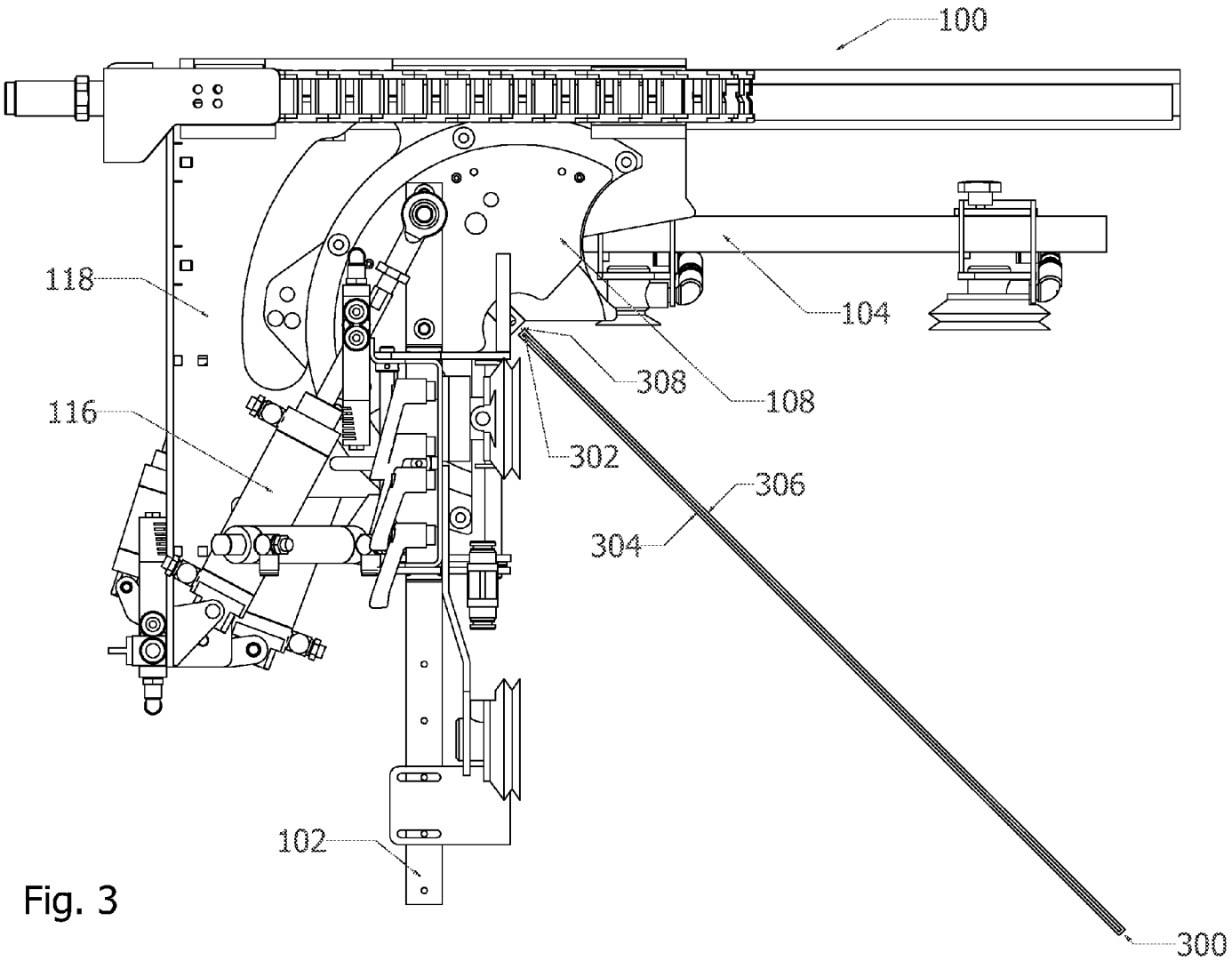
FIG. 3 shows an orthographic top (plan) view of an example case erector, with the arms in the open position.
Figure 3A:
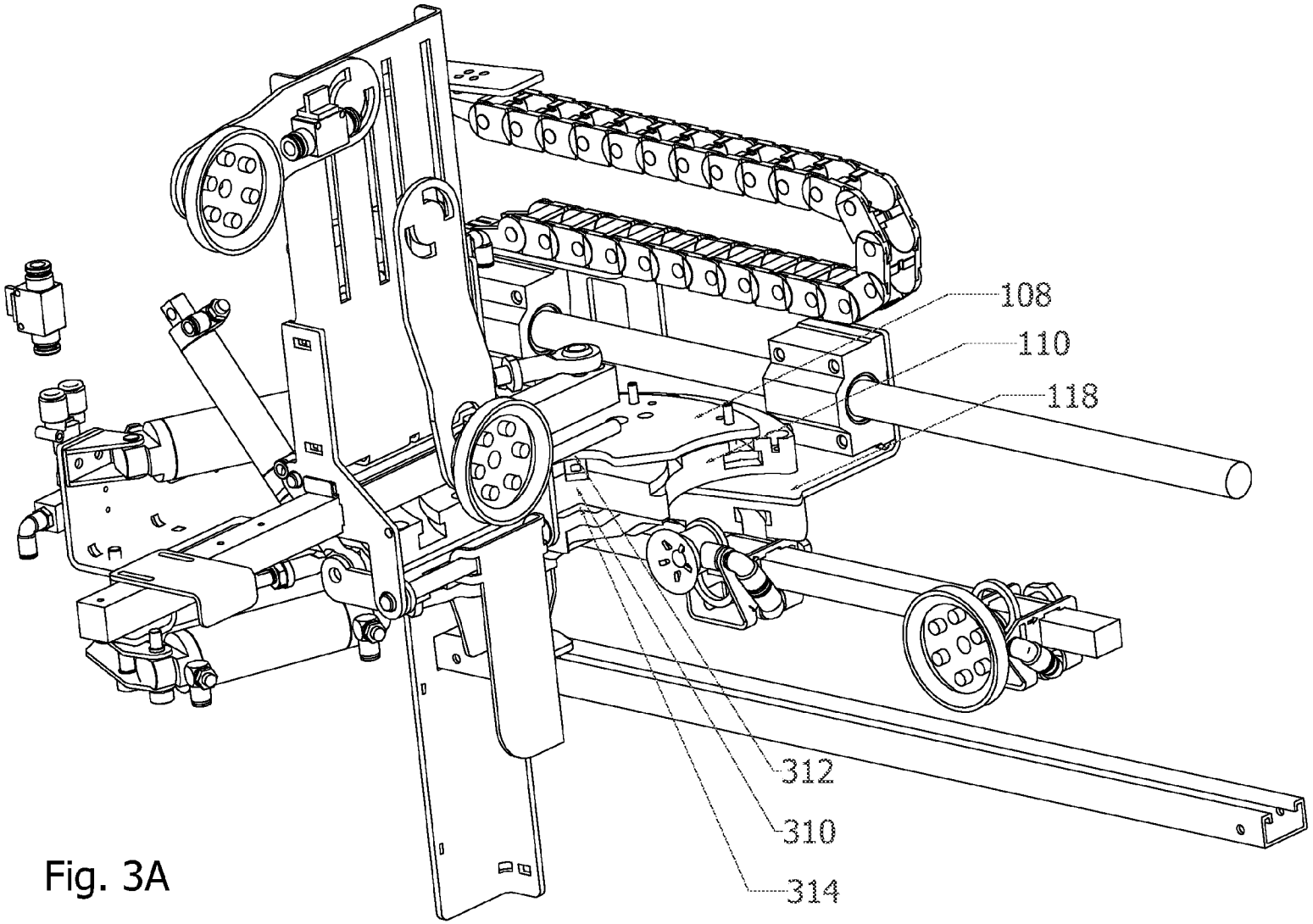
FIG. 3A shows an isometric view similar to that of FIG. 3.

FIG. 3 shows an orthographic top (plan) view of an example case erector 100, with the arms 102, 104 in the open position. In this view, an unopened case 300 is shown. The fold 302 between a first side 304 and a second side 306 of the case 300 is located at the center or virtual center 308 of the semi-circle defined by the channel 114 defined in the bearing surface 110 (better seen in FIG. 1). Thus, the center 308 of the semi-circular channel 114 (see FIG. 1) is located (referring now to FIG. 3A) in a notch 310 defined in the bearing surface 110. Similarly, a notch 312 is defined in the plate 108, which prevents the plate from extending to the center 308. And further, the supporting plate 118 had defined in it a similar notch 314. Thus, the notch 310 in the bearing surface 110, the notch 312 in the plate 108 and the notch 314 in the supporting plate 118 allow the fold 302 of the case 300 to be located at the center point 308.

Note that in the view of FIG. 3, the actuator 116 has extended to rotate the plate 108 supporting arm 102 into its most clockwise position. The plate supporting the arm 104 (and a bearing surface within which is defined a channel that controls movement of the plate) will be better seen in later figures, and is located below the plate 118.

Figure 4:
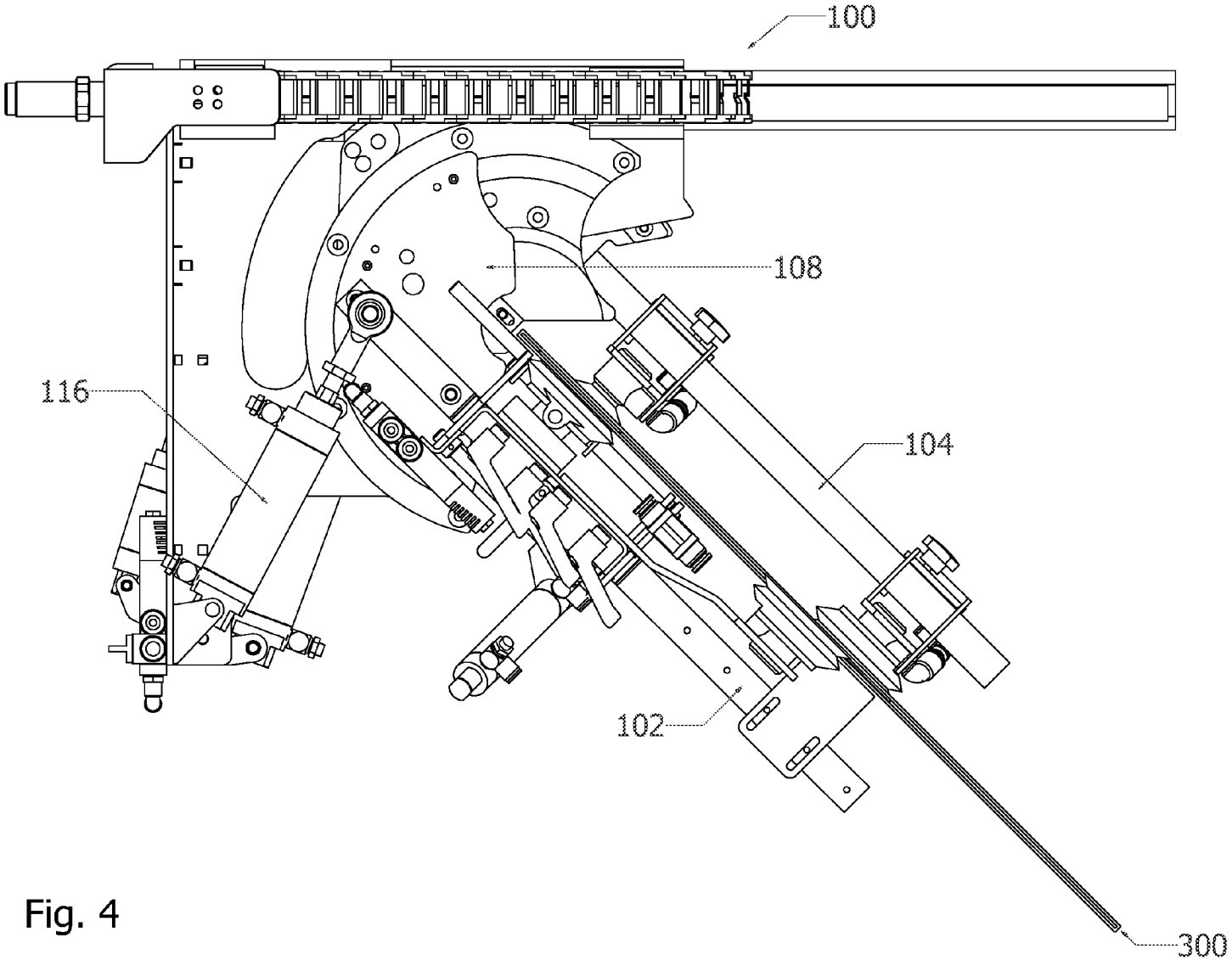
FIG. 4 shows an orthographic top (plan) view of the case erector of FIG. 3, with the arms in the closed position and a case in the unassembled position.

FIG. 4 shows an orthographic top (plan) view of the case erector 100, with the arms 102, 104 in the closed position.

Two adjacent sides of the box 300 have been grasped by the arms. The actuator 116 has retracted, and the plate 108 supporting the arm 102 has rotated counter clockwise in response. Note that when the arms 102, 104 open again to the positions seen in FIG. 3, the box 300 will be opened, with the two adjacent sides 304, 306 still attached to arms 102, 104, respectively.

Figure 5:
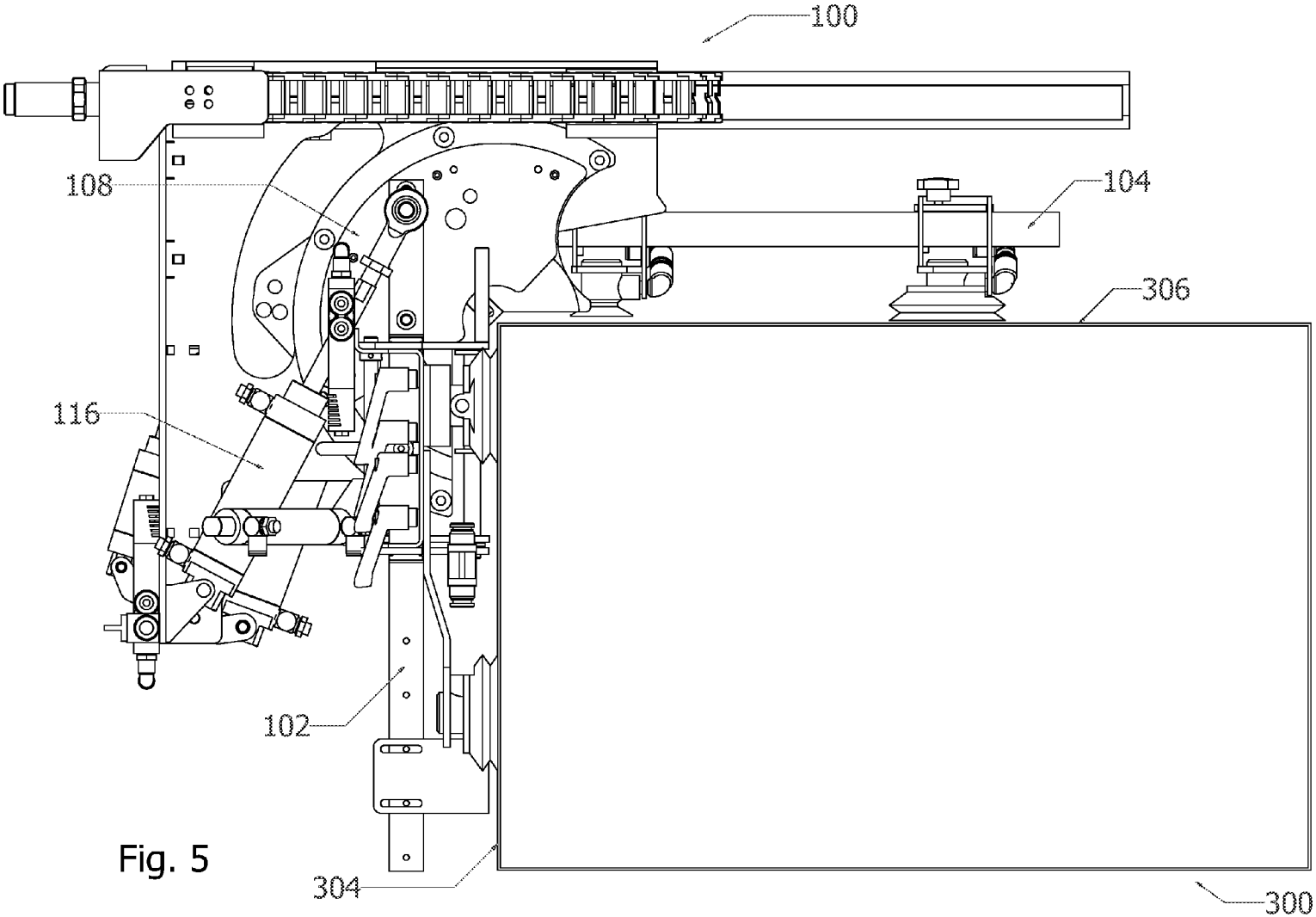
FIG. 5 shows an orthographic top (plan) view of the case erector of FIG. 3, with the arms in the open position and a case in the erected or open position.

FIG. 5 shows an orthographic top (plan) view of the case erector 100, with the arms 102, 104 in the open position and the case fully opened. Two adjacent sides 304, 306 of the box 300 have been moved to separate them by 90 degrees, thereby opening the case (box). The actuator 116 has extended, and the plate 108 supporting the arm 102 has rotated clockwise in response. Note that when the arms 102, 104 open again to the positions seen in FIG. 3, the box 300 will be opened, with the two adjacent sides 304, 306 still attached to arms 102, 104, respectively.

Figure 6:
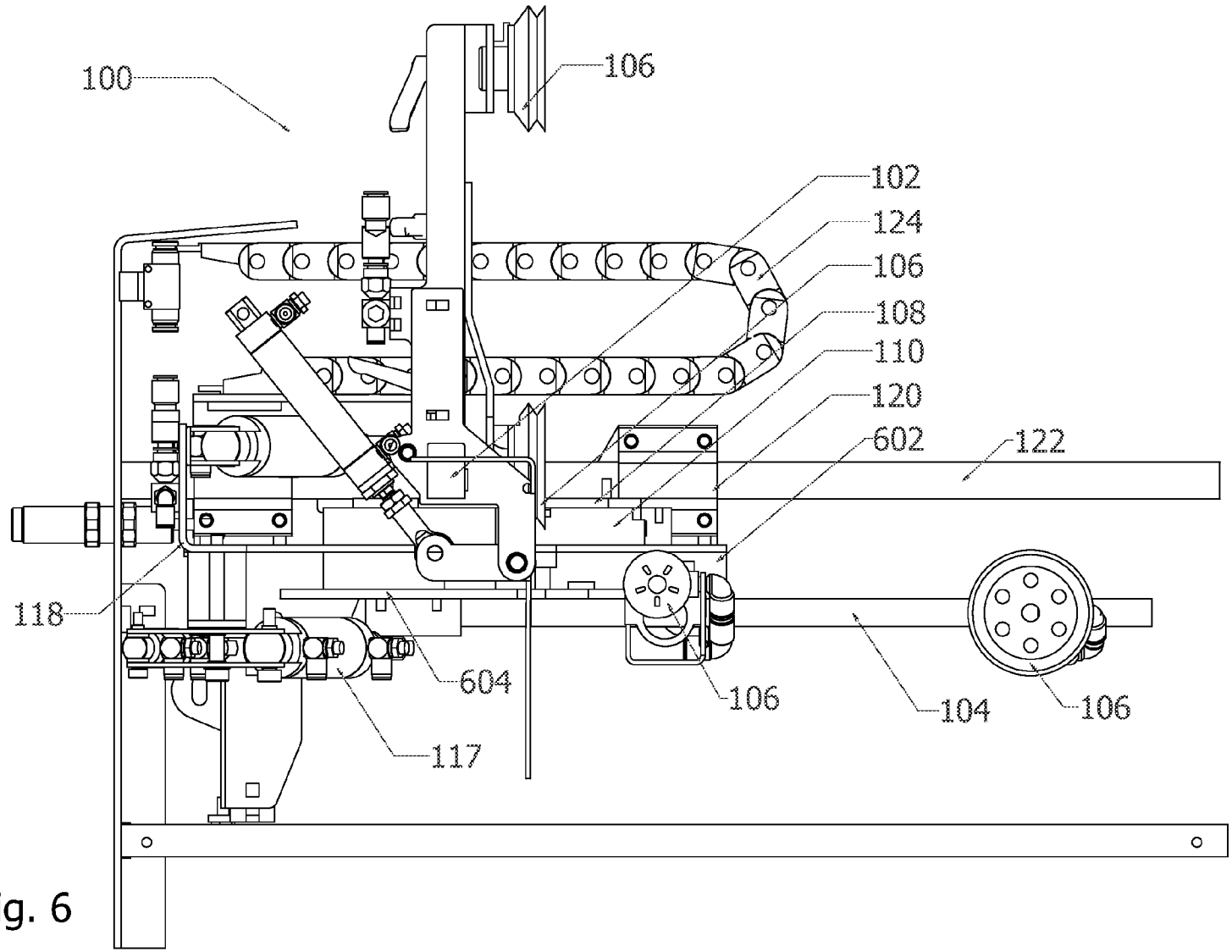
FIG. 6 shows an orthographic side view of an example case erector, with the arms in the open position.

FIG. 6 shows an orthographic side view of an example case erector 100, with the arms 102, 104 in the open position. Note that if an opened box were held by the arms, then the assembly 100 would be ready to move to the right along the bearings 120 and supported by the shaft 122. The hose assembly 124 would extend as the arm assembly moved along the shaft 122.

FIG. 6 shows the plate 108 supporting the arm 102 and the bearing surface 110 seen in perspective in FIG. 1. Below the bearing surface is a flange or base 118. Below the base 118 is a second bearing surface 602 against which rotates a plate 604. The second bearing surface 602 and plate 604 are associated with the second arm 104. The second bearing surface 602 defines a semi-circular channel through which a flange attached to the plate 604 moves. Thus, the bearing surface 602 is stationary, but an actuator 117 moves the plate 604 through approximately 45 degrees in either direction, thereby moving the arm 104 through 45 degrees. The semi-circular channel in the bearing surface 602 has a center point that is along a vertical line that also includes the center point of the channel 114 defined in the bearing surface 110. Thus, both arms 102, 104 pivot about the same virtual center point, and the fold between the two adjacent sides of a case to be opened is positioned along a vertical line through those center points.

Figure 8:
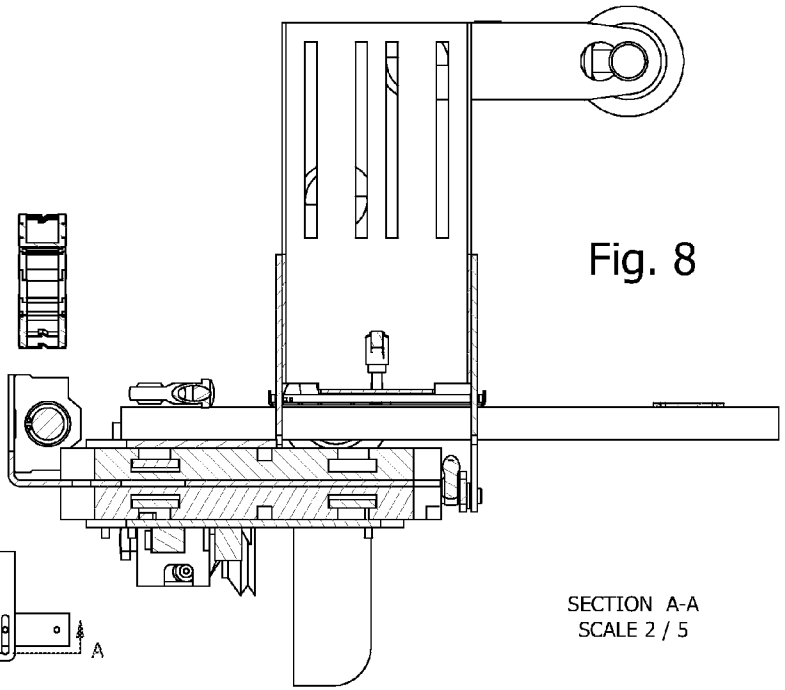
FIG. 8 shows a section view of the bearing assembly of FIG. 7.
Figure 7:
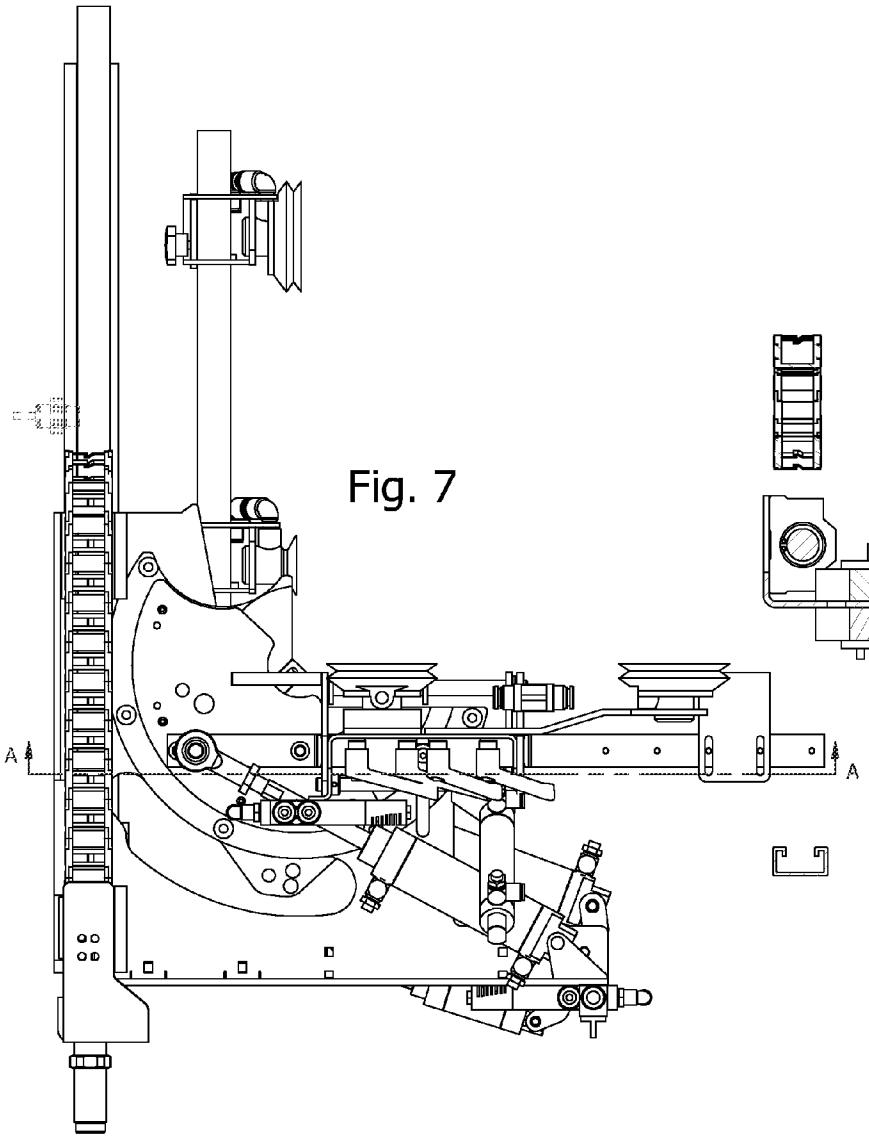
FIG. 7 shows an orthographic top view of an example case erector, with the arms in the open position.

FIGS. 7 and 8 show orthographic views of an example case erector.

Figure 9:
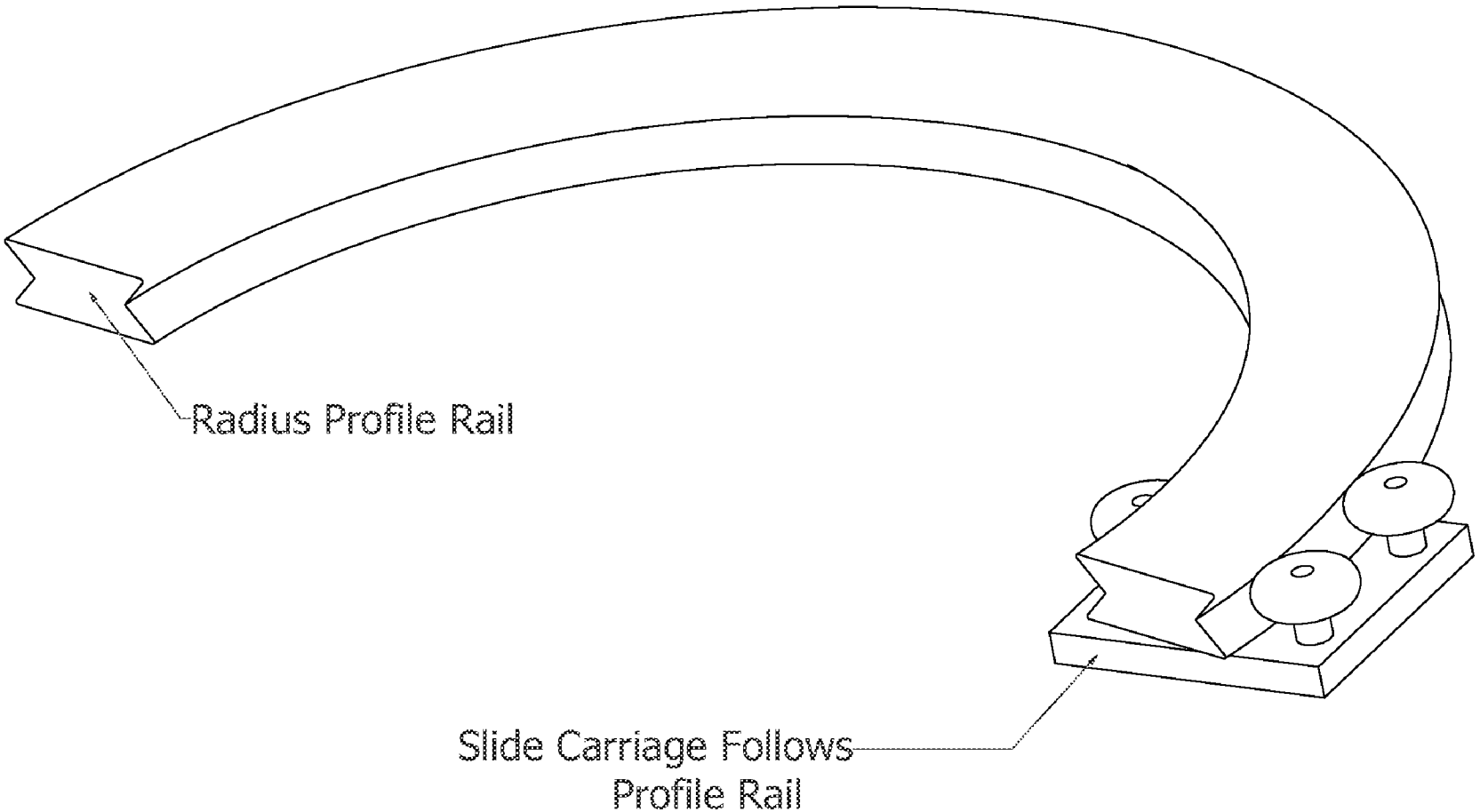
FIG. 9 shows a further example of a bearing surface that could be used in an embodiment of the case erector.

FIG. 9 shows a further example of a bearing surface that could be used in an embodiment of the case erector. Thus, the plastic surface 110 having channel 114 could be replaced by a constant radius rail, or similar, as shown.

CONCLUSION

Although aspects of this disclosure include language specifically describing structural and/or methodological features of preferred embodiments, it is to be understood that the appended claims are not limited to the specific features or acts described. Rather, the specific features and acts are disclosed only as exemplary implementations, and are representative of more general concepts.

The invention claimed is:

1. A case erector, for erecting a case, the case erector comprising:

a planar bearing surface within which is defined a semi-circular channel about a center point, wherein a notch is defined in the planar bearing surface to allow a fold between adjacent sides of the case to be erected to be located at the center point;

a plate in contact with the planar bearing surface, the plate having at least one flange, wherein the at least one flange is sized for travel within the semi-circular channel so that the plate rotates against the planar bearing surface in a circular manner about the center point and wherein a notch is defined in the plate to allow the fold between adjacent sides of the case to be erected to be located at the center point; and an arm connected to the plate, wherein the arm rotates in concert with the plate and wherein the arm has at least one attachment device configured to attach to one of the adjacent sides of the case to be erected; and a second arm connected to a second plate moving against a second planar bearing surface, wherein the second plate has at least one attached flange moving in a semi-circular channel defined in the second planar bearing surface;

wherein the first and second arms each rotate 45 degrees between an open position and a closed position.

2. The case erector of claim 1, wherein the at least one attachment device is a vacuum powered suction cup.

3. The case erector of claim 1, additionally comprising a support base to hold the planar surface, wherein the support base is itself supported by at least two bearing surfaces movable along a shaft.

4. The case erector of claim 1, additionally comprising an actuator connected to result in movement of the plate and the arm in a rotary motion about the center point.

5. The case erector of claim 1, wherein the attachment device is secured at a desired location to an adjustment plate by a bracket configured for attachment to slots defined in the adjustment plate.

6. A case erector, for erecting a case, the case erector comprising:

first and second planar bearing surfaces attached to first and second sides of a support base, wherein a semi-circular channel is defined in each of the first and second planar bearing surfaces, both semi-circular channels having a same center point and wherein a notch is defined in each of the first and second planar bearing surfaces to allow a fold between adjacent sides of the case to be erected to be located at the center point;

first and second plates in contact with the first and second planar bearing surfaces, the first and second plates each having at least one flange, wherein the at least one flange of the first and second plates is sized for travel within the semi-circular channel of the first and second planar bearing surfaces, respectively, so that the first and second plates rotate against the first and second planar bearing surfaces in a circular manner about the center point and wherein a notch is defined in each of the first and second plates to allow the fold between adjacent sides of the case to be erected to be located at the center point; and first and second arms connected to the first and second plates, wherein the arms rotate in concert with the first and second plates, respectively, and wherein each of the arms has at least one attachment device configured to attach to one of the adjacent sides of the case to be erected.

7. The case erector of claim 6, wherein the at least one attachment device is a vacuum powered suction cup.

8. The case erector of claim 6, wherein the support base is attached to at least two bearings, the at least two bearings configured for travel along a shaft.

9. The case erector of claim 6, additionally comprising first and second actuators connected to result in movement of the first and second plates and the first and second arms in a rotary motion about the center point.

10. The case erector of claim 6, wherein each of the attachment devices is secured at a desired location to first and second adjustment plates attached to the first and second arms, respectively, wherein the securing is done by a bracket configured for attachment to slots defined in the first and second adjustment plates.

11. A case erector, comprising:

a planar bearing surface, in which is defined a semi-circular channel about a center point, and in which is defined a notch located so that the planar bearing surface does not extend to the center point of the semi-circular channel;

a plate in contact with the planar bearing surface, the plate having at least one flange, wherein the at least one flange is sized for travel within the semi-circular channel so that the plate rotates against the planar bearing surface in a circular manner about the center point and wherein a notch is defined in the plate so that the plate does not extend to the center point of the semi-circular channel;

an arm connected to the plate, wherein the plate and the arm rotate together with respect to the planar bearing surface;

at least one attachment device attached to the arm and configured to attach to one of two adjacent sides of the case to be erected;

a second bearing surface attached to a second side of a support base, wherein the bearing surface is attached to a first side of the support base, and wherein the second bearing surface defines a second semi-circular channel about the center point;

a second plate moving against the second bearing surface, wherein the second plate has at least one attached flange moving in the second semi-circular channel defined in the second planar bearing surface; and a second arm connected to the second plate.

12. The case erector of claim 11, wherein the notch in the planar bearing surface and the notch in the plate are sized to allow a fold between two adjacent sides of a case to be erected to be inserted to a location wherein the fold is located in the center point of the semi-circular channel.

13. The case erector of claim 11, wherein:

the arm rotates between an open position and a closed position; and rotation of the arm, when the at least one attachment device is attached to the a case to be erected, erects the case from a folded condition.

14. The case erector of claim 11, wherein the at least one attachment device is a vacuum powered suction cup.

15. The case erector of claim 11, additionally comprising a support base to hold the planar surface, wherein the support base is itself supported by at least two bearing surfaces movable along a shaft.

16. The case erector of claim 11, additionally comprising an actuator connected to result in movement of the plate and the arm in a rotary motion about the center point.

17. The case erector of claim 11, wherein the attachment device is secured at a desired location to an adjustment plate by a bracket configured for attachment to slots defined in the adjustment plate.

* * * * *

UNITED STATES PATENT AND TRADEMARK OFFICE

CERTIFICATE OF CORRECTION

PATENT NO. : 7,788,881 B2
APPLICATION NO. : 12/242660
DATED : September 7, 2010
INVENTOR(S) : Michael J. Johnson et al.

It is certified that error appears in the above-identified patent and that said Letters Patent is hereby corrected as shown below:

On the Title Page, below Item (76) Inventors, add --(73) Assignee: Pearson Packaging Systems, Spokane, WA (US)--

Signed and Sealed this
Fourth Day of October, 2011

David J. Kappos

David J. Kappos
*Director of the United States Patent and Trademark Office*